United States Patent [19]

Jani

[11] 4,278,131

[45] Jul. 14, 1981

[54] PORT APPARATUS FOR WELL PIPING

[76] Inventor: William Jani, #2 3401-19 St. NE., Calgary, Canada, T2E 6S8

[21] Appl. No.: 93,535

[22] Filed: Nov. 13, 1979

[51] Int. Cl.[3] ..... E21B 43/00

[52] U.S. Cl. ..... 166/332; 251/319

[58] Field of Search ..... 166/332, 72; 251/319, 251/294

[56] References Cited

U.S. PATENT DOCUMENTS

| | | | |
|---|---|---|---|
| 2,924,278 | 2/1960 | Garrett et al. | 166/332 |
| 3,990,508 | 11/1976 | Boyadjieff et al. | 166/332 |
| 4,094,359 | 6/1978 | King | 166/332 |

*Primary Examiner*—James A. Leppink

*Attorney, Agent, or Firm*—Shlesinger, Arkwright, Garvey & Dinsmore

[57] ABSTRACT

A port apparatus for well piping comprising a sleeve valve mounted in longitudinally slideable engagement with the bore of an outer housing, the sleeve valve having an open position, a pressure equalization position, and a closed position, the sleeve valve also having a first annular shoulder by which the sleeve valve is engaged for moving the sleeve valve from the closed to the pressure equalization position and a second annular shoulder by which the sleeve valve is engaged for moving the sleeve valve from the pressure equalization position to the open position, these first and second annular shoulders being longitudinally spaced by a distance equal to the longitudinal distance between successive sleeve valve positions, a mandrel housing adapted to be positioned in the bore of the outer housing and fixed in longitudinal position relative to the outer housing, a mandrel telescopically mounted in the mandrel housing and adapted for longitudinal travel within predetermined limits relative to the mandrel housing and having shifting keys thereon for engaging one of the sleeve valve annular shoulders when at its extended position and for releasing the sleeve valve annular shoulder when at its retracted position thereby shifting the sleeve valve from one longitudinal position to the next, the sleeve valve annular shoulder which is engaged depending upon which initial position the sleeve valve is in and therefore which annular shoulder the shifting keys encounter when the mandrel is extended.

26 Claims, 9 Drawing Figures

PORT APPARATUS FOR WELL PIPING

BACKGROUND OF THE INVENTION

This invention relates to well port structures and more specifically to a port valve apparatus having a three position sleeve valve and an opening tool therefore.

Sleeve valve devices have been used in oil wells whenever it is desirable to control fluid flow between the interior and exterior of the well tubing. For instance, such devices are used in wells with a plurality of longitudinally spaced geological strata in which it is desired to have only one stratum in communication with the interior of the well tubing at any given time. One sleeve valve device is located at each stratum and opening and closing tools are lowered into the well tubing to manipulate the various valves. Each sleeve valve usually comprises an outer tubular body having a fluid port in the wall thereof and within the bore of the tubular body a sleeve valve in longitudinally slideable engagement with the surface of the bore, the sleeve having a fluid port in the wall thereof. Depending on whether the valve is to be opened or closed, the appropriate tool is lowered into the well to move the sleeve longitudinally to place the fluid ports in register or to move them out of register.

A problem was encountered in opening such sleeve valves when the ambient pressure in the geological stratum was much higher than in the well tubing. The sudden fluid communication resulting from the opening of the sleeve valve could result in the opening tool being blown back up the pipe with resultant damage. The solution to this problem was to equalize the pressure more gradually between the inside of the well tubing and the geological stratum by the use of a three position sleeve valve with an intermediate position between the closed and opened positions at which restricted flow orifices in the sleeve valve are in communication with the port of the outer tubular body. First the sleeve is shifting to the intermediate position for the pressure to equalize after which the sleeve is shifted to the open position for normal fluid flow.

This in turn enhanced the need, also present with the two position valve structure, for an opening tool which could accurately shift the sleeve valve between positions with a positive throw action which would engage the sleeve valve at one position and shift it to a second position disengaging the sleeve valve exactly when the second position is reached.

SUMMARY OF THE INVENTION

An object of this invention is to provide a port apparatus having a telescoping opening tool with a longitudinal throw set by predetermined longitudinal limits coinciding with the longitudinal distance between valve positions.

An object of the invention is to provide a port apparatus having a multiple position sleeve valve adapted for use with a telescoping opening tool having one fixed length throw.

Another object of the invention is to provide a port structure for use with a telescoping opening tool, the port structure having means by which the opening tool is fixed in position relative to the port structure and means by which the opening tool may engage the port's sleeve valve regardless of the longitudinal position of the sleeve valve.

An object of this invention is to provide a multiple position sleeve valve and a telescoping opening tool for the sleeve valve which opening tool operates from a fixed longitudinal position relative to the sleeve valve housing and has a longitudinal throw set between predetermined longitudinal limits regardless of the position of the sleeve valve, the sleeve valve having successive longitudinally spaced engagement members with the opening tool engaging whichever member it is opposite at the beginning of its throw to shift the sleeve valve from one longitudinal position to the next successive longitudinal position.

An object of this invention is to provide a port apparatus having an opening tool with a locating key system for positioning the tool in a fixed longitudinal position and a shifting key mechanism for engaging the sleeve valve at one of its positions and disengaging the sleeve valve after it has been shifted to the next successive position by the opening tool.

These and other objects, which will become apparent from the following description, are achieved by a port apparatus for well piping comprising an outer tubular housing having a bore and port means in the wall thereof; a tubular sleeve valve mounted in the bore in longitudinally slideable engagement with the surface of the bore, the sleeve valve having at least one port means in the wall thereof and at least two longitudinal positions with respect to the outer tubular housing for placing the at least one sleeve valve port means either opposed to and in fluid communication with the outer tubular housing port means or longitudinally removed from and out of fluid communication with the outer tubular housing port means; the sleeve valve having at least one member by which the sleeve valve is engaged for moving the sleeve valve between the at least two longitudinal positions; a tubular mandrel housing positionable in the bore having locating key means in its exterior wall fixed in longitudinal relationship with respect to the mandrel housing; receiving means for the locating key means positioned in the surface of the bore of the outer tubular housing at a predetermined longitudinal distance from the outer tubular housing port means, the locating key means and the locating key receiving means cooperating when in engagement to prevent longitudinal movement of the mandrel housing toward the sleeve valve; a mandrel telescopically mounted in the mandrel housing having a retracted position when located at one end of its longitudinal travel generally within the mandrel housing and an extended position when located at the opposite end of its longitudinal travel generally extended from the mandrel housing; means mounted on the mandrel for attaching the mandrel to a sleeve valve engagement member when the attaching means is adjacent a sleeve valve engagement member, the distance of the mandrel housing from the sleeve valve being such that the attaching means is adjacent a sleeve valve engagement member when the mandrel is substantially at the extended position; and, means for detaching the mandrel from the sleeve valve engagement member to which it is attached when the mandrel is substantially at the retracted position; the point on the travel of the mandrel at which the attaching means attaches a sleeve valve engagement member and the mandrel and the point on the travel of the mandrel at which the detaching means detaches the attached sleeve valve engagement member and the mandrel defining a distance equal to the longitudinal distance between the at least two longitudinal positions of the sleeve valve; whereby, when the sleeve valve is in a first longitudinal position and the mandrel is extended, the attaching means attaches a sleeve valve engagement member and the mandrel acts to move the sleeve valve from its first longitudinal position to a second longitudinal position.

DETAILED DESCRIPTION

Figure 1:
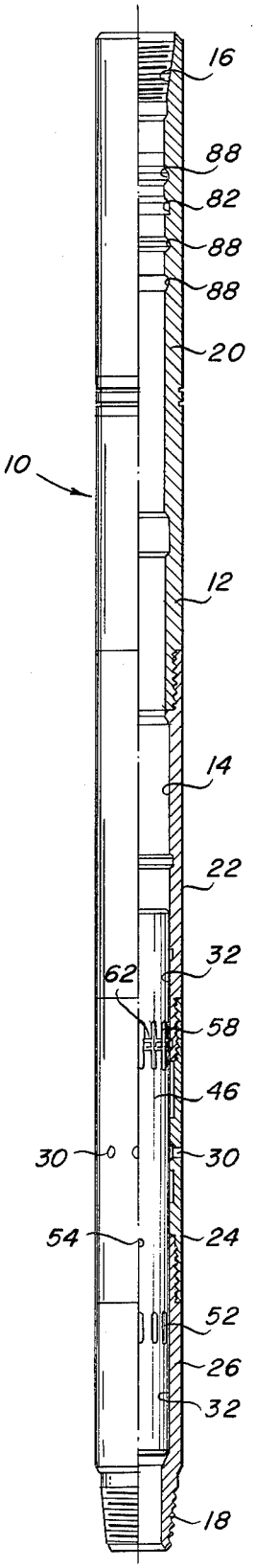
FIGS. 1, 2 and 3 are diagramatic views showing the outer housing of a port apparatus according to this invention with the sleeve valve therein shown respectively in the lower most or closed position, the intermediate or pressure equalization position, and in the uppermost or open position.
Figure 2:
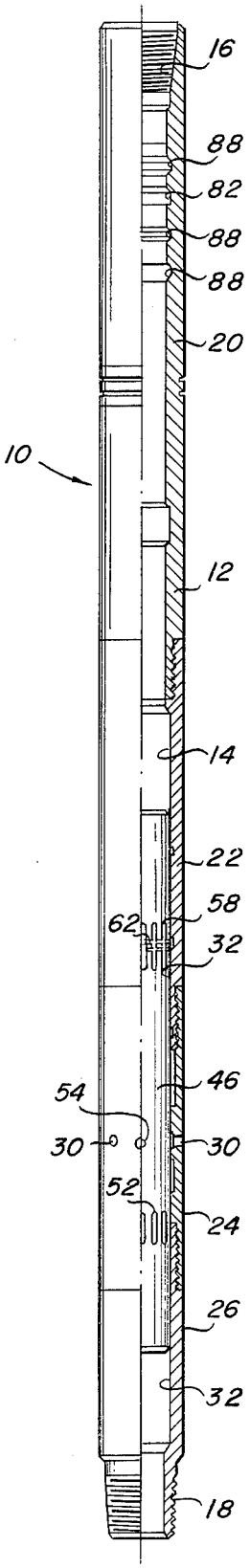
Figure 3:
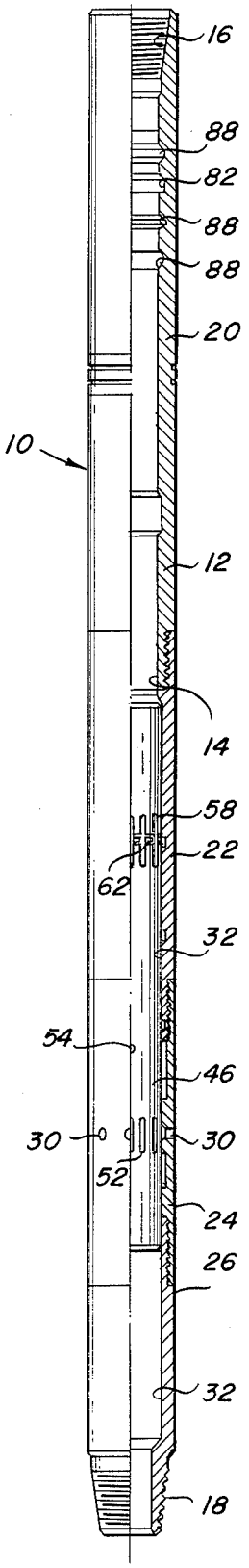

Referring to the figures, a port tool 10 is shown having an outer tubular housing 12 with a central bore 14. The outer tubular housing 12 has an internal threaded portion 16 at the top thereof and an external threaded portion 18 at the bottom thereof by which the outer tubular housing 12 may be connected to other well piping. The outer tubular housing 12 is an assembly of four interconnected sections 20, 22, 24, 26, each interconnection having an annular chamber in which are disposed O-rings or seals 28 which provide seals between the sections.

A port 30 comprising a plurality of circumferentially spaced lateral apertures is located in outer tubular housing 12 in a recessed bore area 32 having a diameter slightly greater than the main portion of the bore 14. The port 30 includes an internal annular recess 34 which is dish-shaped in cross section. The recessed bore area 32 has an upper sloping shoulder 36 and a lower sloping shoulder 38 at its respective ends. Located in the recessed area 32 are recessed annular depressions 40, 42, 44, the distance between the lowermost depression 40 and the intermediate depression 42 being equal to the distance between the intermediate depression 42 and the uppermost depression 44.

Figure 6:
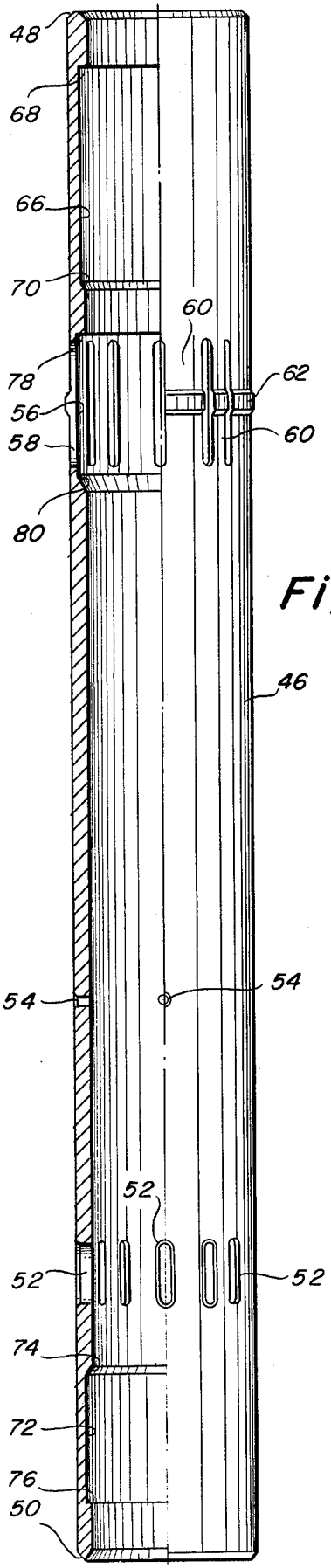
FIG. 6 is a view of the sleeve valve partially in section.

Situated in this recessed bore area 32 is a tubular sleeve valve 46 which is in longitudinally slideable engagement with the surface of the recessed area 32. The sleeve valve 46, which is shown separately in FIG. 6, terminates at its upper end in an annular beveled shoulder 48 and at its lower end in an oppositely facing corresponding annular beveled shoulder 50. The sleeve valve 46 contains a fluid flow port 52 which corresponds to the port 30 of the outer tubular housing 12 comprising a plurality of circumferentially spaced lateral apertures through its wall. Also located in the wall of the sleeve valve 46 longitudinally spaced from the sleeve valve fluid flow port 52 are four circumferentially spaced restricted orifices 54 which function as a pressure equalization port as will be described below. The longitudinal distance between the sleeve valve fluid flow port 52 and the pressure equalization port 54 is equal to the longitudinal distances between the depressions 40 and 42 and the depressions 42 and 44.

The sleeve valve 46 has an area of increased diameter in its bore forming an annular recess 56 which contains a plurality of circumferentially spaced longitudinally elongated apertures 58. These apertures combine with the relative thinness of the wall of the sleeve valve 46 in this annular recess 56 to form a plurality of resilient spaced bands 60 capable of resiliently flexing laterally. Situated at the approximate midpoint of each band 60 is a raised area or boss 62 projecting outward to make contact with the surface of the bore 14.

The sleeve valve 46 thus has three longitudinally spaced positions determined by the interaction of the bands 60 with the wall of the bore 14 in the recessed area 32. When the bosses 62 are opposite one of the annular depressions 40, 42, 44, the resilient bands assume a flat rest position with the bosses 62 projecting into the depression thus positively positioning the sleeve valve 46 longitudinally. In the sleeve valve's being shifted from one position to the next the bosses 62 are biased inwardly by the wall of the bore 14 and the resilient bands 60 are also thus flexed inwardly.

In its lowermost or first position the sleeve valve 46 is so positioned that neither the fluid flow port 52 nor the pressure equalization port 54 is opposed to and in fluid communication with the outer tubular housing port 30. Thus the port 30 is closed. When in this position, the bosses 62 are engaged by the depression 40 and the shoulder 50 of the sleeve valve 46 is longitudinally adjacent the sloping shoulder 38 at the end of the bore recessed area 32. In its intermediate or second position the sleeve valve 46 is so positioned that the pressure equalization port 54 is opposed to and in fluid communication with the outer tubular housing port 30 with the bosses 62 engaged by the depression 42. When the sleeve valve 46 is in this intermediate position, restricted fluid flow is permitted between the outside and inside of the well piping thus allowing a gradual equalization of pressure between the inside and outside and, consequently, avoiding a sudden pressure surge which could damage the well apparatus. In its third or uppermost position, the sleeve valve 46 is positioned so that the fluid flow port 52 is opposed to and in fluid communication with the outer tubular housing port 30 with the bosses 62 engaging the depression 44. Thus unrestricted fluid flow is permitted with the port 30 now open. Also in this uppermost position the upper shoulder 48 of the sleeve valve 46 is adjacent the sloping shoulder 36 at the upper end of the bore recessed area 32. The sleeve valve 46 thus travels upward relative to the outer tubular housing 12 to shift the tool 10 from the closed to the intermediate then to the open positions. To close the tool 10 the sleeve valve 46 is shifted downward from the open to the closed position through the intermediate position.

To prevent any leakage between the sleeve valve 46 and the wall of the bore 14, seal assemblies 64 are located in annular recesses in the wall of the bore 14 immediately above and below the outer tubular housing port 30 engaging both the wall of the bore 14 and the surface of the sleeve valve 46. These seal assemblies are constructed in a manner known in the art and, generally, may comprise a plurality of resilient chevron type elements with appropriate back-up rings.

Located in the bore wall of the sleeve valve 46 is an upper annular recess 66 having an upper shoulder 68 lying in a plane substantially perpendicular to the longitudinal axis of the tool 10 and a lower longitudinally sloped shoulder 70. Similar to the upper recess 66, there is a lower annular recess 72 in the lower wall of the sleeve valve 46 having a longitudinally sloped upper shoulder 74 and a lower shoulder 76 lying in a plane substantially perpendicular to the longitudinal axis of the tool 10. Also, the annular recess 56 terminates at its upper end in an annular shoulder 78 which lies in a plane substantially perpendicular to the longitudinal axis of the tool 10 and terminates at its lower end in a longitudinally sloped shoulder 80. The perpendicular shoulders 68 and 78 are longitudinally spaced by a distance equal to the longitudinal distance between successive valve positions, i.e. the distance between the closed and pressure equalization valve positions or the distance between the pressure equalization and open valve positions which are equal. These perpendicular shoulders 68 and 78 act as engagement members by which an opening tool attaches itself to the sleeve valve 46 for shifting the sleeve valve 46 between positions as will be explained hereinafter. The perpendicular shoulder or first engagement member 68 is used to shift the sleeve valve 46 from the closed to the pressure equalization position while the perpendicular shoulder or second engagement member 78 is engaged to shift the sleeve valve 46 from the pressure equalization position to the open position. The perpendicular shoulder 76 serves as a third engagement member and is engaged by a closing tool to shift the sleeve valve 46 from the open to the closed position.

Located in the wall of the bore 14 of the outer tubular housing 12 above the port 30 and recessed area 32 at a predetermined distance from the port 30 is an annular recess 82 for receiving and positioning the opening tool as will be described hereinafter. This annular recess 82 has a longitudinally sloped upper shoulder 84 and a lower shoulder 86 lying in a plane substantially perpendicular to the longitudinal axis of the tool 10. The perpendicular shoulder 86 thus faces away from the recessed area 32 containing the sleeve valve 46. Also located in the wall of the bore 14 adjacent this main annular recess 82 are a plurality of secondary annular recesses 88 having sloping upper and lower shoulders. The dimensions of the main recess 82 and the secondary recesses 88 and their longitudinal spacing are arranged according to a predetermined pattern.

To move the sleeve valve 46 from its closed to its pressure equalization position or from its pressure equalization position to its open position, an opening tool 90 is lowered into the bore 14. The opening tool 90 has a tubular mandrel housing 92 and a mandrel 94. The mandrel housing 92 is an assembly of a key body 96, spring sleeve 98, and releasing sleeve 100. The mandrel 94 comprises an upper portion 102 and a lower portion 104 joined by a coupler 106.

The mandrel housing 92 has locating keys 108 mounted in slots in the exterior wall thereof. Each locating key 108 has a spring 110 biasing the key 108 laterally outward into engagement with the wall of the bore 14. The keys 108 are prevented from longitudinal movement relative to the mandrel housing 92 by their abutting contact with the upper and lower shoulders 112, 114 of the slots in which they are located. Each key 108 has a flange 116 which is similar in cross sectional configuration to the main annular recess 82 having a lower shoulder 118 lying in a plane substantially perpendicular to the longitudinal axis of the port tool 10 facing toward the recessed area 32 containing the sleeve valve 46 and an upper shoulder 120 sloped longitudinally. In addition to this main flange 116, the locating keys 108 also have secondary flanges 122 having sloped shoulders corresponding in cross sectional dimensions with the annular recesses 88 of the bore wall 14. The main flange 116 and the plurality of flanges 122 are longitudinally spaced in a pattern corresponding to the longitudinal pattern of the main annular recess 82 and the plurality of annular recesses 88.

The mandrel 94 is telescopically mounted in the mandrel housing 92, the mandrel 94 being capable of longitudinal travel relative to the mandrel housing 92 between a retracted position generally within the mandrel housing 92 and an extended position generally extended from the mandrel housing 92. Mounted on the internal wall of the mandrel housing 92 is an annular flange 124 and mounted on the mandrel 94 is annular flange 126. Positioned between the flanges 124, 126 is a coil spring 128 which is compressed when, due to the relative movement of the mandrel 94 and mandrel housing 92, the flanges 124, 126 move toward one another. Thus the spring 128 cooperates with the mandrel housing 92 and mandrel 94 to bias the mandrel 94 towards its retracted position, it requiring forced applied to the mandrel 94 to extend it from the mandrel housing 92.

Figure 5:
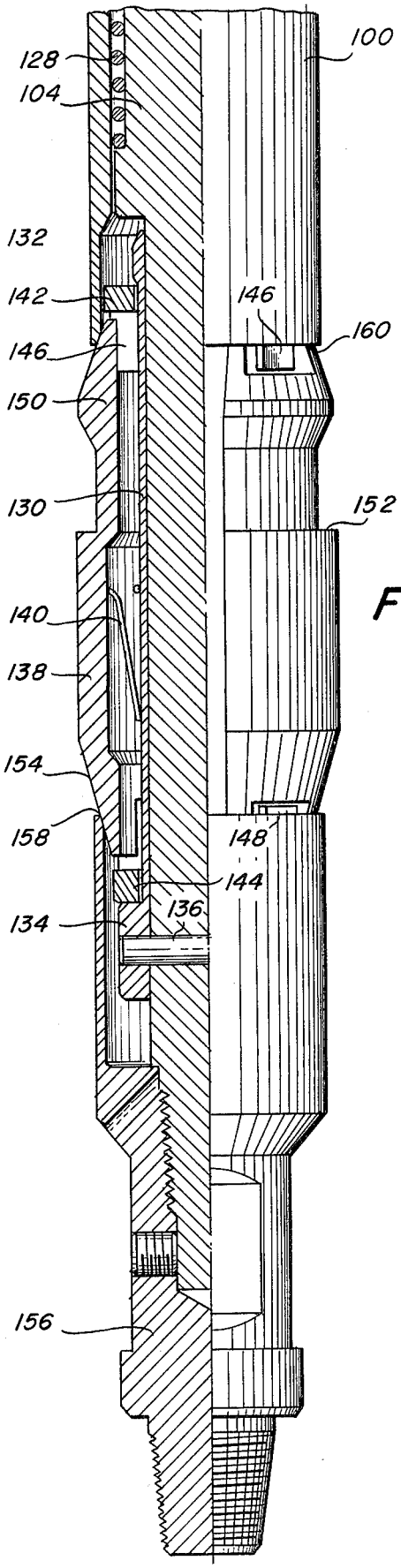
FIG. 5 is an enlarged fragmentary sectional view showing the mandrel and shifting key assembly of the port apparatus according to this invention.

Referring particularly to FIG. 5, mounted on the projecting end of the mandrel 94 is a sleeve 130 having upper and lower annular shoulders 132, 134 respectively. The sleeve 130 is held in position by a sheer pin 136 which extends into the body of the lower mandrel portion 104. Mounted in turn on the sleeve 130 are a plurality of laterally movable shifting keys 138 each having a spring 140 mounted between it and the sleeve 130 to bias the shifting keys 138 laterally outward. The shifting keys 138 are prevented from longitudinal movement relative to the mandrel 94 by retaining rings 142, 144 which are in turn held in position by the sleeve shoulders 132, 134. Each retaining ring 142, 144 has projecting therefrom longitudinally into a pocket in one of the shifting keys 138 lugs 146, 148 which cooperate with the shifting keys 138 to limit their outward lateral movement beyond a predetermined limit.

Each shifting key 138 has a boss 150 at the end thereof closer to the mandrel housing 92 with beveled camming shoulders, the upper shoulder being inclined inwardly toward the mandrel housing 92. Situated below the boss 150 on each shifting key 138 is an annular shoulder 152 lying in a plane substantially perpendicular to the longitudinal axis of the tool 10 and facing toward the mandrel housing 92 which is in the direction opposite to the facing of the perpendicular engagement shoulders 68 and 78. Each shifting key 138 has at the end thereof farther from the mandrel housing 92 a beveled camming shoulder 154 which is inclined inwardly away from the mandrel housing 92.

Mounted on the lower end of the mandrel 94 is a retracting device 156 which has an upwardly longitudinally projecting barrel ending in an annular lip 158. During normal operations the camming shoulders 154 of the shifting keys 138 rest on this lip 158 so that the shifting keys 138 in moving laterally outward pivot slightly on this lip 158.

In operation, beginning with the sleeve valve 46 in the closed position, the opening tool is lowered into the outer tubular housing 12 by means of an appropriate apparatus which is connected to the top of the mandrel 94 by a fishneck (not shown). Initially, the mandrel 94 is in the fully retracted position. When the opening tool 90 reaches the level of the sleeve valve 46, the locating keys 108 in the mandrel housing 92 will engage the annular recesses 82, 88 in the wall of the bore 14 bringing the substantially perpendicular shoulders 86 and 118 of the recess 82 and locating keys 108 respectively into laterally overlapping abutting engagement thus preventing further longitudinal movement of the mandrel housing 92 toward the sleeve valve 46 and the recessed area 32 of the bore 14.

It should be noted that the shoulders 86 and 118 can not come into overlapping engagement unless the dimensions and longitudinal spacing of the recesses 82, 88 and flanges 116, 122 correspond. Thus the predetermined longitudinal patterns of the opening tool positioning recesses 82, 88 and the locating keys 108 can be used to insure that the keys 108 will engage the recesses 82, 88 only and no other substantially perpendicular shoulders elsewhere in the well.

Figure 4:
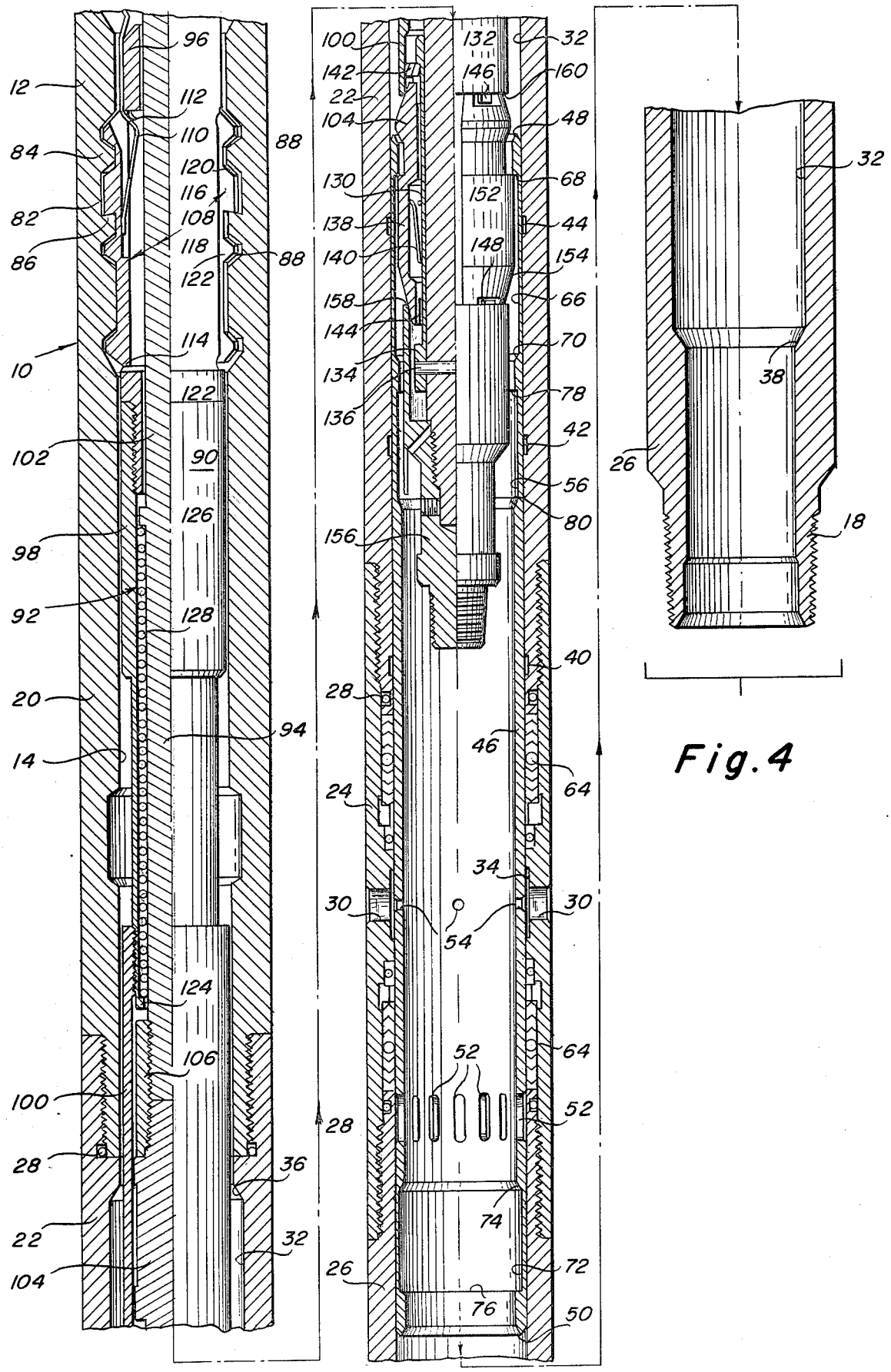
FIG. 4 is an enlarged longitudinal sectional view showing a port apparatus according to this invention with the opening tool about to detach itself from the sleeve valve which has just been shifted from the closed to the pressure equalization position.
Figure 7:
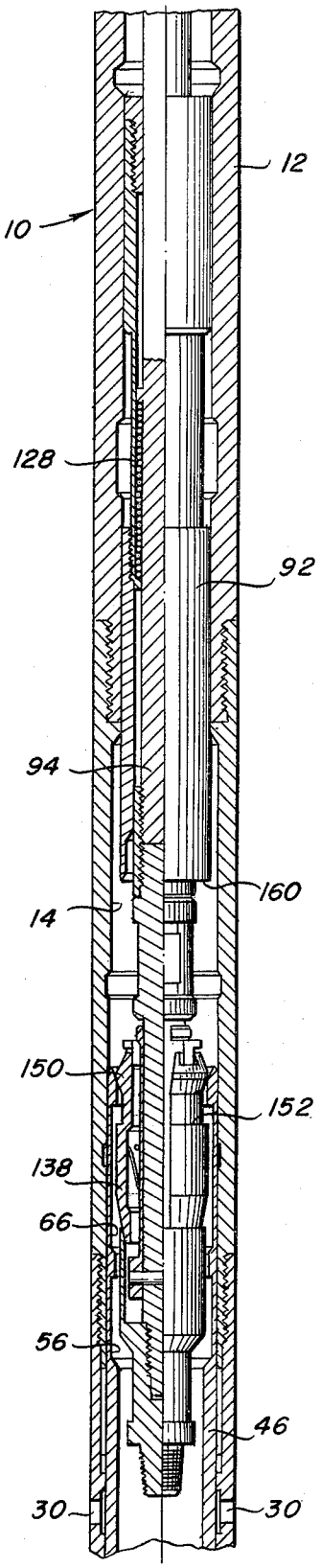
FIGS. 7, 8 and 9 are diagrammatic views of the apparatus according to this invention in various stages of operation.

With the mandrel housing 92 in a fixed predetermined longitudinal position relative to the rest of the port tool 10, additional force applied to the mandrel 94 moves the mandrel 94 downward and out of its fully retracted position thus compressing the spring 128 and loading the opening tool 90. Referring to FIG. 7, downward movement of the mandrel 94 continues until the spring is fully compressed at which point, due to the longitudinal dimensions of the elements of the port tool 10, the shifting keys 138 are located such that their substantially perpendicular shoulders 152 are just below the first engagement shoulder 68 of the sleeve valve 46. The mandrel 94 of the now fully loaded opening tool 90 is now released and the mandrel 94 is thrown to the fully retracted position by the action of the spring 128. The mandrel housing 92 is prevented from any downward recoil by its engagement with the recess 82. As the mandrel 94 travels upward and while it is still substantially in its extended position, the shifting keys 138 come adjacent the first engagement shoulder 68, which faces away from the mandrel housing 92, and attach the mandrel 94 to the sleeve valve 46 by the substantially perpendicular shoulders 152 of the keys 138, which face toward the mandrel housing 92, coming into laterally overlapping abutting relation with the first engagement shoulder 68. The mandrel 94 thus moves the sleeve valve 46 upward shifting it from the closed to the pressure equalization position. The longitudinal dimensions of the respective elements of the tool 10 are so set that, when the pressure equalization position of the sleeve valve 46 is reached, the shifting keys 138 are coming into engagement with the lower end of the mandrel housing 92 as shown in FIG. 4. The circular end of mandrel housing 92 comprises an annular camming sleeve 160. As the mandrel 94 approaches its retracted position and is substantially at its retracted position, the upward camming shoulders of the bosses 150 engage the camming sleeve 160 which moves the shifting keys 138 laterally inwardly thus detaching the mandrel 94 from the sleeve valve 46 by bringing the abutting engaged shoulders 68, 152 out of engagement just as the sleeve valve 46 enters the pressure equalization position. Thus the point on the travel of the mandrel 94 at which the shifting keys 138 attach the sleeve valve 46 to the mandrel 94 and the point at which the camming sleeve 160 breaks the attachment define a distance equal to the distance between the closed and pressure equalization positions of the sleeve valve 46.

Figure 8:
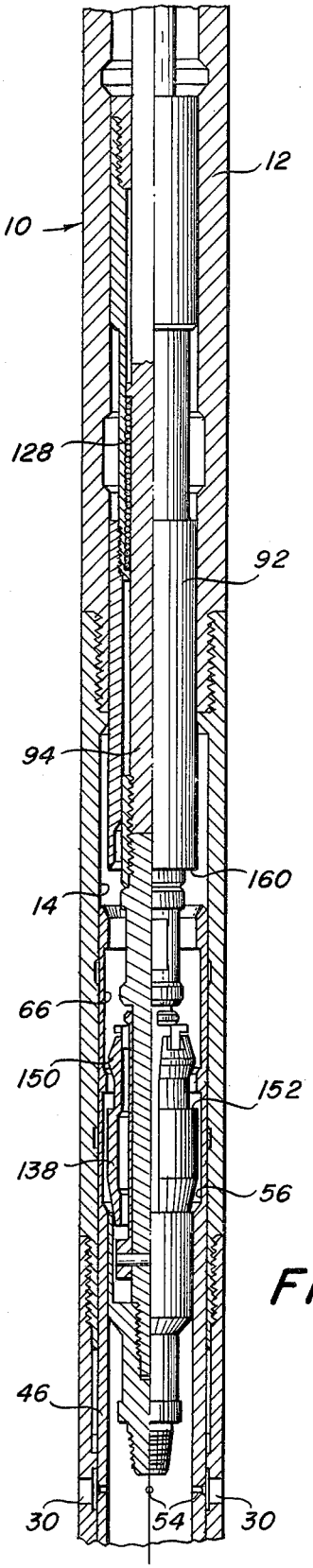
Figure 9:
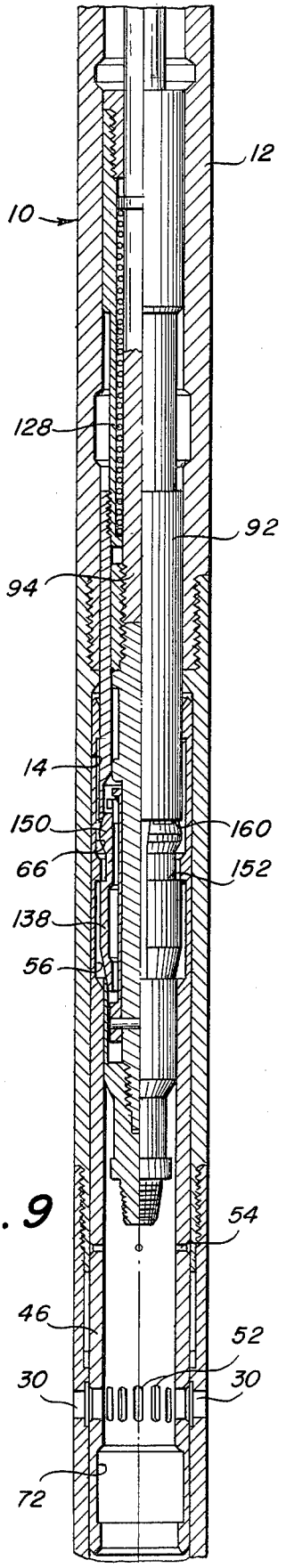

Once the well pressures are equalized and it is desired to shift the sleeve valve 46 from the pressure equalization position to the open position, the procedure is repeated. Referring to FIGS. 8 and 9, in this second opening operation the mandrel housing 92 remains in the same location and therefore the mandrel's retracted and extended positions are at the same longitudinal locations relative to the outer tubular housing 12 but now the sleeve valve 46 is in a higher position.

As the mandrel 94 is now extended, it travels farther into the bore of the sleeve valve 46 and, when its fully extended position is reached, the shifting keys 138 are located such that their substantially perpendicular shoulders 152 are now just below the second engagement shoulder 78 of the sleeve valve 46. This is due to the fact that, while the sleeve valve 46 is one position higher, the distance of the first sleeve valve engagement shoulder 68 from the second shoulder 78 is equal to the distance between positions. Thus the second engagement shoulder 78 assumes the first engagement shoulder's position relative to the mandrel 94 when the sleeve valve 46 is in the pressure equalization position. When the mandrel 94 is released, the apparatus functions in a manner identical to its functioning in opening the sleeve valve 46 from the closed to the pressure equalization position only with the shifting keys 138 engaging the second engagement shoulder 78 and with the sleeve valve 46 thus being shifted from the pressure equalization position to the open position.

The opening tool 90 does not need to be adjusted in any fashion or repositioned longitudinally to switch from shifting the sleeve valve 46 from the closed to the pressure equalization position to shifting the sleeve valve 46 from the pressure equalization position to the open position. The mandrel 94 starting from the same longitudinal position relative to the outer tubular housing 12 extends to the same longitudinal position relative to the outer tubular housing 12 and engages whatever sleeve valve engagement member is located at that point regardless of the position of the sleeve valve 46 and shifts the sleeve valve 46 one position higher.

To close the sleeve valve 46, i.e. to move it downward from the open position through the pressure equalization position to the closed position, a closing tool (not shown) is used in place of the opening tool 90. Such a closing tool can be a separate apparatus or may be arrived at by modifying the opening tool 90. If the mandrel lower portion 104 is disconnected from the coupler 106 and turned over end for end and lowered into the well by appropriate apparatus, the shifting keys 138 will be reversed with their substantially perpendicular shoulders 152 now facing downward. In this orientation the shifting keys 138 engage the third engagement shoulder 76 of the sleeve valve 46 by coming into laterally overlapping abutting engagement with that shoulder. Thus attached, the sleeve valve 46 can be shifted downward.

In the event that the sleeve valve 46 should become stuck while being shifted upward thus making it impossible to detach the opening tool 90 and remove it from the well, a safety feature is built into the mandrel 94. With the sleeve valve 46 stuck, the operator need only apply enough upward force to the mandrel 94 to sheer the sheer pin 136. When this occurs the mandrel 94 will move upward relative to the sleeve 130 which is still held in place. Thus the retracting device 156 will cam the shifting keys 138 inward through the engagement of its annular lip 158 with the camming shoulder 154 of each shifting key 138 and bring the shifting keys 138 out of engagement with the sleeve valve 46 permitting the removal of the opening tool 90 from the well.

While the invention has been described in terms of a three position sleeve valve having two longitudinally spaced engagement shoulders for opening the sleeve valve, valves having a different number of longitudinal positions may be used, it being only required that they have an appropriate number of engagement shoulders corresponding to the number of their longitudinal positions.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A port apparatus for well piping, comprising:

an outer tubular housing having a bore and port means in the wall thereof;

a tubular sleeve valve mounted in said bore in longitudinally slideable engagement with the surface of said bore, said sleeve valve having at least one port means in the wall thereof and at least two longitudinal positions with respect to said outer tubular housing for placing said at least one sleeve valve port means either opposed to and in fluid communication with said outer tubular housing port means or longitudinally removed from and out of fluid communication with said outer tubular housing port means;

said sleeve valve having at least one member by which said sleeve valve is engaged for moving said sleeve valve between said at least two longitudinal positions;

a tubular mandrel housing positionable in said bore having locating key means in its exterior wall fixed in longitudinal relationship with respect to said mandrel housing;

receiving means for said locating key means positioned in the surface of said bore of said outer tubular housing at a predetermined longitudinal distance from said outer tubular housing port means, said locating key means and said locating key receiving means cooperating when in engagement to prevent longitudinal movement of said mandrel housing toward said sleeve valve;

a mandrel telescopically mounted in said mandrel housing having a retracted position when located at one end of its longitudinal travel generally within said mandrel housing and an extended position when located at the opposite end of its longitudinal travel generally extended from said mandrel housing;

means mounted on said mandrel for attaching said mandrel to a sleeve valve engagement member when said attaching means is adjacent a sleeve valve engagement member, the distance of said mandrel housing from said sleeve valve being such that said attaching means is adjacent a sleeve valve engagement member when said mandrel is substantially at said extended position; and, means for detaching said mandrel from said sleeve valve engagement member to which it is attached when said mandrel is substantially at said retracted position;

the point on the travel of said mandrel at which said attaching means attaches a sleeve valve engagement member and said mandrel and the point on the travel of said mandrel at which said detaching means detaches said attached sleeve valve engagement member and said mandrel defining a distance equal to the longitudinal distance between said at least two longitudinal positions of said sleeve valve;

whereby, when said sleeve valve is in a first longitudinal position and said mandrel is extended, said attaching means attaches a sleeve valve engagement member and said mandrel acts to move said sleeve valve from its first longitudinal position to a second longitudinal position.

2. The port apparatus of claim 1 wherein each of said at least one sleeve valve engagement member comprises an annular shoulder lying in a plane substantially perpendicular to the longitudinal axis of said port apparatus and facing away from said mandrel housing.

3. The port apparatus of claim 2 wherein said attaching means comprises laterally moving shifting key members having spring means biasing said shifting key members laterally outward, each of said shifting key members having a shoulder in a plane substantially perpendicular to the longitudinal axis of said port apparatus and facing toward said mandrel housing whereby each of said shifting key members attaches to a sleeve valve engagement member by said shifting key shoulder coming into laterally overlapping abutting relationship with said annular shoulder of said sleeve valve engagement member as said mandrel moves from said extended position toward said retracted position.

4. The port apparatus of claim 3 wherein:

the end of each of said shifting key members closer to said mandrel housing comprises a beveled camming shoulder inclined inwardly toward said mandrel housing; and, the end of said mandrel housing from which said mandrel extends comprises an annular camming sleeve, said detaching means comprising said annular camming sleeve whereby said camming sleeve engages said camming shoulder of each of said shifting key members as said mandrel moves towards said retracted position for camming each of said shifting key members laterally inward thus detaching said shoulder of each of said shifting key members from its overlapping abutting contact with said annular shoulder of said sleeve valve enagement member to which it is attached.

5. An opening tool for use with a well piping port valve, the port valve having a sleeve valve mounted in longitudinally slideable engagement witn the bore of an outer housing, the sleeve valve having at least two longitudinal positions and at least one member by which the sleeve valve is engaged for moving the sleeve valve from one of its longitudinal positions to another, the opening tool comprising:

a mandrel housing positionable in the bore of the outer housing and having means for engaging the bore of the outer housing for locating said mandrel housing in a fixed longitudinal position relative to the port valve and preventing longitudinal movement of said mandrel housing toward the port valve during operation of the opening tool;

a mandrel telescopically mounted in said mandrel housing and adapted for longitudinal travel relative to said mandrel housing between an extended position generally extended from said mandrel housing and a retracted position generally within said mandrel housing;

means mounted on said mandrel for attaching said mandrel to a sleeve valve engagement member when said attaching means is adjacent a sleeve valve engagement member, the distance of said mandrel housing from the sleeve valve being such that said attaching means is adjacent a sleeve valve engagement member when said mandrel is substantially at said extended position; and, means for detaching said mandrel from the sleeve valve engagement member to which said mandrel is attached when said mandrel is substantially at said retracted position;

the point on the travel of said mandrel at which said attaching means attaches a sleeve valve engagement member and said mandrel and the point on the travel of said mandrel at which said detaching means detaches the engagement member and said mandrel defining a distance equal to the longitudinal distance between the longitudinal positions of the sleeve valve;

whereby, when the sleeve valve is in a first longitudinal position and said mandrel is extended, said attaching means attaches a sleeve valve engagement member and said mandrel acts to move the sleeve valve from its first longitudinal position to a second longitudinal position.

6. The opening tool of claim 5 wherein said attaching means comprises laterally moving shifting key members having spring means biasing said shifting key members laterally outward, each of said shifting key members having a shoulder lying in a plane substantially perpendicular to the longitudinal axis of said opening tool and facing toward said mandrel housing whereby each of said shifting key members attaches a sleeve valve engagement member by said shifting key shoulder coming into laterally overlapping abutting relationship with a sleeve valve engagement member.

7. A port apparatus for well piping, comprising:

an outer tubular housing having a bore and port means in the wall thereof;

a tubular sleeve valve mounted in said bore in longitudinally slideable engagement with the surface of said bore, said sleeve valve having fluid flow port means and pressure equalization port means in the wall thereof, said pressure equalization port means being longitudinally spaced from said fluid flow port means, said sleeve valve having a first longitudinal position with respect to said outer tubular housing at which neither said sleeve valve fluid flow port means nor said sleeve valve pressure equalization port means is opposed to and in fluid communication with said outer tubular housing port means, a second longitudinal position at which said sleeve valve pressure equalization port means is opposed to and in fluid communication with said outer tubular housing port means and a third longitudinal position at which said sleeve valve fluid flow port means is opposed to and in fluid communication with said outer tubular housing port means, said second position being located beween and equally distant from said first and third positions;

said sleeve valve having a first member by which said sleeve valve is engaged for moving said sleeve valve from said first position to said second position and a second member by which said sleeve valve is engaged for moving said sleeve valve from said second position to said third position, said first and second engagement members being longitudinally spaced by a distance equal to the longitudinal distance between said first position and said second position;

a tubular mandrel housing positionable in said bore having locating key means in its exterior wall fixed in longitudinal relationship with respect to said mandrel housing;

receiving means for said locating key means positioned in the surface of said bore of said outer tubular housing at a predetermined longitudinal distance from said outer tubular housing port means, said locating key means and said locating key receiving means cooperating when in engagement to prevent longitudinal movement of said mandrel housing toward said sleeve valve;

a mandrel telescopically mounted in said mandrel housing having a retracted position when located at one end of its longitudinal travel generally within said mandrel housing and an extended position when located at the opposite end of its longitudinal travel generally extended from said mandrel housing;

means mounted on said mandrel for attaching said mandrel to one of said sleeve valve engagement members when said attaching means is adjacent one of said sleeve valve engagement members, the distance of said mandrel housing from said sleeve valve being such that said attaching means is adjacent said one of said sleeve valve engagement members when said mandrel is substantially at said extended position; and, means for detaching said mandrel from said one of said sleeve valve engagement members when said mandrel is substantially at said retracted position;

the point on the travel of said mandrel at which said attaching means attaches said one of said sleeve valve engagement members and said mandrel and the point on the travel of said mandrel at which said detaching means detaches said one of said sleeve engagement members and said mandrel defining a distance equal to the longitudinal distance between said positions of said sleeve valve;

whereby, when said sleeve valve is in said first position and said mandrel is extended, said attaching means attaches said first sleeve valve engagement member and said mandrel acts to move said sleeve valve from said first position to said second position, and, when said sleeve valve is in said second position and said mandrel is extended, said attaching means attaches said second sleeve valve engagement member and said mandrel acts to move said sleeve valve from said second position to said third position.

8. The port apparatus of claim 7 wherein said first and second sleeve valve engagement members each comprises an annular shoulder lying in a plane substantially perpendicular to the longitudinal axis of said port apparatus and facing away from said mandrel housing.

9. The port apparatus of claim 7 wherein said sleeve valve includes a third engagement member by which said sleeve valve is engaged for moving said sleeve valve from said third position to said first position.

10. The port apparatus of claim 8 wherein said sleeve valve includes a third engagement member by which said sleeve valve is engaged for moving said sleeve valve from said third position to said first position, said third sleeve valve engagement member comprising an annular shoulder lying in a plane substantially perpendicular to the longitudinal axis of said port apparatus and facing in the opposite longitudinal direction from said first and second sleeve valve engagement members.

11. The port apparatus of claim 8 wherein said attaching means comprises laterally moving shifting key members having spring means biasing said shifting key members laterally outward, each of said shifting key members having a shoulder lying in a plane substantially perpendicular to the longitudinal axis of said port apparatus and facing toward said mandrel housing whereby each of said shifting key members attaches to one of said sleeve valve engagement members by said shifting key shoulder coming into laterally overlapping abutting relationship with said annular shoulder of said sleeve valve engagement member as said mandrel moves from said extended position toward said retracted position.

12. The port apparatus of claim 11 wherein:

the end of each of said shifting key members closer to said mandrel housing comprises a beveled camming shoulder inclined inwardly toward said mandrel housing; and, the end of said mandrel housing from which said mandrel extends comprises an annular camming sleeve, said detaching means comprising said annular camming sleeve whereby said camming sleeve engages said camming shoulder of each of said shifting key members as said mandrel moves towards said retracted position for camming each of said shifting key members laterally inward thus detaching said shoulder of each of said shifting key members from its overlapping abutting contact with said annular shoulder of said sleeve valve engagement member.

13. The port apparatus of claim 1 or 7 and including a spring means cooperating with said mandrel housing and said mandrel for biasing said mandrel toward said retracted position.

14. The port apparatus of claim 1 or 7 wherein said locating key receiving means comprises a main annular recess in said bore of said outer tubular housing, said main annular recess having an annular shoulder lying in a plane substantially perpendicular to the longitudinal axis of said port apparatus and facing away from said sleeve valve.

15. The port apparatus of claim 14 wherein said locating key means comprises laterally moving locating key members having spring means biasing said locating key members laterally outward, each of said locating key members having a shoulder with a surface lying in a plane substantially perpendicular to the longitudinal axis of said port apparatus and facing toward said sleeve valve whereby said each of said locating key members prevents longitudinal movement of said mandrel housing toward said sleeve valve by coming into laterally overlapping abutting engagement with said annular shoulder of said locating key receiving means.

16. The port apparatus of claim 15 wherein:

said locating key receiving means includes a plurality of longitudinally spaced annular recesses in said bore of said outer tubular housing adjacent said main annular recess, said plurality of recesses and said main recess being arranged in a predetermined longitudinal pattern; and, said locating key members each includes a plurality of longitudinally spaced flanges adjacent said locating key shoulder, said plurality of longitudinally spaced flanges and said locating key shoulder being arranged in a predetermined longitudinal pattern corresponding to the longitudinal pattern of said locating key receiving means so that each of said locating key members can only engage said locating key receiving means when the longitudinal pattern of said locating key members is in register with the longitudinal pattern of said locating key receiving means.

17. A well piping port valve apparatus for use with an opening tool, the opening tool having a mandrel housing adapted to be fixed in longitudinal position relative to the port valve and a mandrel telescopically mounted in the mandrel housing and adapted for longitudinal travel within predetermined limits relative to the mandrel housing between an extended position at which the mandrel engages said port valve and a retracted position at which the mandrel disengages from said port valve, the port valve apparatus comprising:

an outer tubular member having a bore and port means in the wall thereof;

a tubular sleeve valve mounted in said bore in longitudinally slideable engagement with the surface of said bore, said sleeve valve having fluid flow port means and pressure equalization port means in the wall thereof, said pressure equalization port means being longitudinally spaced from said fluid flow port means, said sleeve valve having a first longitudinal position with respect to said outer tubular member at which neither said sleeve valve fluid flow port means nor said sleeve valve pressure equalization port means is opposed to and in fluid communication with said outer tubular member port means, a second longitudinal position at which said sleeve valve pressure equalization port means is opposed to and in fluid communication with said outer tubular member port means and a third longitudinal position at which said sleeve valve fluid flow port means is opposed to and in fluid communication with said outer tubular member port means, said second position being located between and equally distant from said first and third positions;

said sleeve valve having a first member by which said sleeve valve is engaged by the mandrel for moving said sleeve valve from said first position to said second position, a second member by which said sleeve valve is engaged by the mandrel for moving said sleeve valve from said second position to said third position, and a third member by which said sleeve valve is engaged for moving said sleeve valve from said third position to said first position, said first and second engagement members being longitudinally spaced by a distance equal to the longitudinal distance between said first position and said second position; and, receiving means for the opening tool mandrel housing in the surface of said bore for fixing the mandrel housing in one longitudinal position relative to said port valve and preventing longitudinal movement of the mandrel housing toward said port valve during operation of the opening tool.

18. The port valve apparatus of claim 17 wherein said first, second and third engagement members each comprises an annular shoulder lying in a plane substantially perpendicular to the longitudinal axis of said port valve apparatus.

19. The port valve apparatus of claim 17 wherein said receiving means for the opening tool comprises a main annular recess in said bore of said outer tubular member, said main annular recess having an annular shoulder lying in a plane substantially perpendicular to the longitudinal axis of said port valve apparatus and facing away from said sleeve valve.

20. The port valve apparatus of claim 19 wherein said receiving means includes a plurality of longitudinally spaced annular recesses in said bore of said outer tubular member adjacent said main annular recess, said plurality of recesses and said main recess being arranged in a predetermined longitudinal pattern.

21. An opening tool for use with a well piping port valve, the port valve having a sleeve valve mounted in longitudinally slideable engagement with the bore of an outer housing, the sleeve valve having an open position, a pressure equalization position, and a closed position, the pressure equalization position being between and equally distant from the closed and open positions, the sleeve valve also having a first member by which the sleeve valve is engaged for moving the sleeve valve from the closed to the pressure equalization position and a second member by which the sleeve valve is engaged for moving the sleeve valve from the pressure equalization position to the open position, the first and second sleeve valve engagement members being longitudinally spaced by a distance equal to the longitudinal distance between the closed position and the pressure equalization position, the opening tool comprising:

a mandrel housing positionable in the bore of the outer housing and having means for engaging the bore of the outer housing for locating said mandrel housing in a fixed longitudinal position relative to the port valve and preventing longitudinal movement of said mandrel housing toward the port valve during operation of the opening tool;

a mandrel telescopically mounted in said mandrel housing and adapted for longitudinal travel relative to said mandrel housing between an extended position generally extended from said mandrel housing and a retracted position generally within said mandrel housing;

means mounted on said mandrel for attaching said mandrel to one of the sleeve valve engagement members when said attaching means is adjacent one of the sleeve valve engagement members, the distance of said mandrel housing from the sleeve valve being such that said attaching means is adjacent one of the sleeve valve engagement members when said mandrel is substantially at said extended position; and, means for detaching said mandrel from the one of the sleeve valve engagement members to which said mandrel is attached when said mandrel is substantially at said retracted position;

the point on the travel of said mandrel at which said attaching means attaches one of the sleeve valve engagement members and said mandrel and the point on the travel of said mandrel at which said detaching means detaches the sleeve valve engagement member and said mandrel defining a distance equal to the longitudinal distance between successive positions of the sleeve valve;

whereby, when the sleeve valve is in the closed position and said mandrel is extended, said attaching means attaches the first sleeve valve engagement member and said mandrel acts to move the sleeve valve from the closed to the pressure equalization position, and, when the sleeve valve is in the pressure equalization position and said mandrel is extended, said attaching means attaches the second sleeve valve engagement member and said mandrel acts to move the sleeve valve from the pressure equalization to the open position.

22. The opening tool of claim 21 wherein said attaching means comprises laterally moving shifting key members having spring means biasing said shifting key members laterally outward, each of said shifting key members having a shoulder lying in a plane substantially perpendicular to the longitudinal axis of said opening tool and facing toward said mandrel housing whereby each of said shifting key members attaches to one of the sleeve valve engagement members by said shifting key shoulder coming into laterally overlapping abutting relationship with a sleeve valve engagement member as said mandrel moves from said extended position toward said retracted position.

23. The opening tool of claim 6 or 22 wherein:

the end of each of said shifting key members closer to said mandrel housing comprises a beveled camming shoulder inclined inwardly toward said mandrel housing; and, the end of said mandrel housing from which said mandrel extends comprises an annular tubular camming sleeve, said detaching means comprising said annular tubular camming sleeve whereby said camming sleeve engages said camming shoulder of each of said shifting key members as said mandrel moves toward said retracted position to cam each of said shifting key members laterally inward thus detaching said shoulder of each of said shifting key members from its overlapping abutting contact with the sleeve valve engagement member.

24. The opening tool of claim 5 or 21 and including spring means cooperating with said mandrel housing and said mandrel for biasing said mandrel toward said retracted position.

25. The opening tool of claim 5 or 21 wherein said means for engaging the bore of the outer housing comprises laterally moving locating key members having spring means biasing said locating key members radially outward, each of said locating key members having a shoulder with a surface lying in a plane substantially perpendicular to the longitudinal axis of said opening tool and facing toward said attaching means.

26. The opening tool of claim 25 wherein said locating key members each includes a plurality of longitudinally spaced flanges adjacent said locating key shoulder, said plurality of longitudinally spaced flanges and said locating key shoulder being arranged in a predetermined longitudinal pattern.

* * * * *